US007375684B2

(12) United States Patent
Thudor et al.

(10) Patent No.: US 7,375,684 B2
(45) Date of Patent: May 20, 2008

(54) MULTIBAND PLANAR ANTENNA

(75) Inventors: Franck Thudor, Rennes (FR); François Baron, Cesson Sevigne (FR); Françoise Le Bolzer, Rennes (FR)

(73) Assignee: Thomson Licensing, Boulogne-Billancourt (FR)

( * ) Notice: Subject to any disclaimer, the term of this patent is extended or adjusted under 35 U.S.C. 154(b) by 0 days.

(21) Appl. No.: 11/064,350

(22) Filed: Feb. 23, 2005

(65) Prior Publication Data

US 2005/0190112 A1 Sep. 1, 2005

(30) Foreign Application Priority Data

Mar. 1, 2004 (FR) ..... 04 50400

(51) Int. Cl.
*H01Q 1/38* (2006.01)

(52) U.S. Cl. ..... 343/700 MS; 343/767

(58) Field of Classification Search ..... 343/700 MS, 343/767, 768, 769, 770, 846
See application file for complete search history.

(56) References Cited

U.S. PATENT DOCUMENTS

| | | | | |
|---|---|---|---|---|
| 4,509,209 | A * | 4/1985 | Itoh et al. | 455/327 |
| 5,005,019 | A * | 4/1991 | Zaghloul et al. | 343/700 MS |
| 5,181,042 | A * | 1/1993 | Kaise et al. | 343/700 MS |
| 6,828,942 | B2 * | 12/2004 | Louzir et al. | 343/769 |
| 6,999,038 | B2 * | 2/2006 | Louzir et al. | 343/770 |
| 2004/0090376 | A1 * | 5/2004 | Dai et al. | 343/700 MS |
| 2004/0090379 | A1 * | 5/2004 | Fourdeux et al. | 343/700 MS |

FOREIGN PATENT DOCUMENTS

WO WO 01/20718 A 3/2001

OTHER PUBLICATIONS

Search Report, 2001.
Guangping Zhou "Shorting-pin loaded annular ring microstrip antenna" Antennas and Propagation Society International Symposium, 1998 IEEE Atlanta, GA Jun. 21-16, 1998 New York, NY IEEE, US.
Ishii N et al. "Analysis On the Mechanism 1-10 of a Tuning Stub for Circular-Polarized Annular Microstrip Antenna" Electronics & Communications, Scripts Technica New York, US vol. 78, No. 11 pp. 43-501 Nov. 1995.
Tanaka M et al. "Suppressing Undesired Modes in a Higher-Order Mode Microstrip Ring Patch Antenna" Electronics & Communications in Japan, Part 1—Communications, Scripta Technica New York, US vol. 85, No. 3, Part 1 Mar. 2002 vol. 85, No. 3, Part 1 pp. 9-18.

* cited by examiner

*Primary Examiner*—Huedung Mancuso
(74) *Attorney, Agent, or Firm*—Joseph J. Laks; Robert D. Shedd; Brian J. Cromarty

(57) ABSTRACT

The present invention relates to a multiband planar antenna consisting of at least one resonator formed of an element having a closed shape made on a substrate and dimensioned so as to operate in its fundamental mode at the resonant frequency of the lowest band. The resonator is fed by a feed line in such a way as to operate in all the higher modes. The resonator comprises means for modifying the resonant frequencies of the various modes in such a way as to cover the bands concerned.

9 Claims, 7 Drawing Sheets

MULTIBAND PLANAR ANTENNA

This application claims the benefit, under 35 U.S.C. § 119 of French Patent Application 0450400, filed Mar. 1, 2004.

The present invention relates to a multiband planar antenna, and more particularly to a multiband planar antenna suited to wireless networks operating with distinct frequency bands.

BACKGROUND OF THE INVENTION

Within the framework of the deployment of wireless networks, the design of antennas is confronted with a particular problem due to the way in which the various frequencies are allocated to these networks. Thus, in the case of domestic wireless networks according to the IEEE802.11b and IEEE802.11a standards, a frequency band at 2.4 GHz and two disjoint frequency bands around 5 GHz have been allocated for the deployment of wireless networks according to these standards. In this case, the spectrum to be covered is therefore composed of three disjoint sub-bands. The same phenomenon is encountered in respect of antennas that have to operate on two disjoint frequency bands such as GSM, GPRS, UMTS antennas, etc.

Moreover, several standards currently exist for wireless networks and the products currently used in these networks follow one or other of these standards. Therefore, it is necessary to have antennas able to operate on disjoint frequency bands.

To remedy this type of problem, the most obvious solution consists in using a wideband antenna which at one and the same time covers all the frequency bands required. It is apparent however that the use of a wideband antenna is not desirable for such coverage. Specifically, in this case, the band covered is very large relative to the necessary band, presenting various drawbacks. Thus, the use of a wideband antenna may encourage the degradation of the performance of the receiver on account of the presence of jammers operating in the band covered by the antenna and, in particular, the band not allocated in application thereof. Moreover, it requires more severe filtering constraints at the level of the transmitter in order to comply with the out-of-band transmission power masks. This generally entails a high cost in respect of the design of the antenna and of the equipment that makes it operate.

Another solution consists in using an antenna operating on a lower frequency band but capable of frequency agility so as to switch over to one or other of the bands. In this case, it is necessary to use one or more active elements to modify the operating frequency of the resonant antenna. However, such a structure is more complex and hence more expensive. Moreover, antennas of this type do not make it possible to cover distantly separated frequency bands.

SUMMARY OF THE PRESENT INVENTION

The present invention proposes a passive solution making it possible to ensure multi-standard coverage while avoiding the use of a wideband antenna.

The present invention relates to a multiband planar antenna consisting of at least one resonator formed of an element having a closed shape made on a substrate and dimensioned so as to operate in its fundamental mode at the resonant frequency of the lowest band, the resonator being fed by a feed line in such a way as to operate in all the higher modes. The resonator comprises, in accordance with the present invention, elements modifying the resonant frequencies of the various modes in such a way as to cover the bands chosen.

According to a preferred embodiment, the elements modifying the resonant frequencies of the various modes consist of projections positioned in short-circuit zones of the resonator at the chosen operating mode. In this case, the modification of the resonant frequency of the chosen mode is obtained by adjusting the surface area of the projections.

Preferably, the relation between the resonant frequency of a mode and the surface area of the projections is of the type:

$f_i=a_i^k*S^k+b_i^k$ where i represents the mode, k represents the projection to which the alteration is made, $S^k$ represents the surface area of the associated projection and $(a_i^k, b_i^k)$ represent the coefficients of the curve obtained for each mode and for each configuration.

Preferably, the projections are of polygonal or cylindrical shape and are provided on the inner profile of the resonator, on the outer profile of the resonator or on both sides.

Moreover, the resonator consists of a slot of closed shape etched on a printed substrate, such as an annular slot or a slot of polygonal shape.

According to another embodiment, the resonator consists of a microstrip technology annulus made on a substrate.

According to another characteristic of the present invention, the feed line is made in microstrip technology or in coplanar technology, the line terminating in a short-circuit after the feed line/resonator transition.

Preferably, the short-circuit is provided at a distance $\lambda m/16$ from the transition with $\lambda m$ the guided wavelength in the feed line.

According to yet another characteristic of the invention, the feed line consists of a coaxial cable the central core of which is connected to the interior of the resonator and the earth of which is connected to the exterior of the resonator.

BRIEF DESCRIPTION OF THE DRAWINGS

Other characteristics and advantages of the present invention will become apparent on reading the description given hereinbelow of various embodiments, this description being given with reference to the appended drawings, in which.

DESCRIPTION OF PREFERRED EMBODIMENTS

The present invention will be described while referring to an antenna of the annular slot type making it possible to ensure coverage of the standards at 2.4 GHz and at 5 GHz, namely, to cover the frequency bands allocated for the Hyperlan2 and IEEE802.11a standards. It is obvious to the person skilled in the art that the present invention may be applied to other types of standard and use an antenna made in a technology other than slot technology such as microstrip technology.

The structure and the manner of operation of a multiband planar antenna consisting of an annular slot fed by a feed line in microstrip technology, according to a line/slot transition, will firstly be described with reference to FIGS. 1 to 3.

Figure 1:
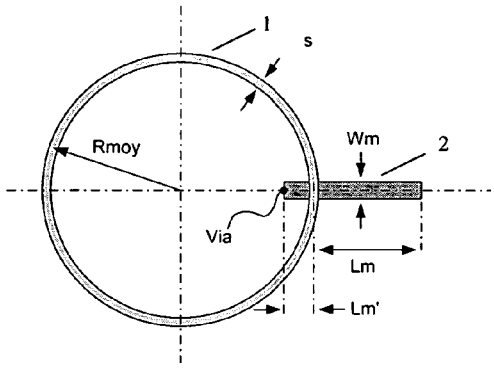
FIG. 1 is a diagrammatic view of an antenna of annular slot type fed by a microstrip line to which the present invention may be applied.
Figure 2:
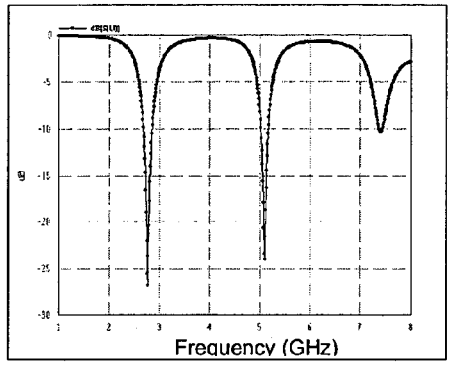
FIG. 2 represents the matching curve as a function of frequency for the antenna of FIG. 1.

As represented diagrammatically in FIG. 1, the antenna consists of a slot 1 made by etching a metallized substrate on its two faces. In the embodiment represented, the slot 1 forms a circle of mean radius $R_{moy}$ and of width Ws. On the substrate face opposite the face receiving the etching is provided a feed line 2 consisting of a microstrip line. This line feeds the slot 1 with energy by electromagnetic coupling. The feed line extends beyond the line/slot transition over a length Lm'. Lm' is chosen preferably such that Lm'=λm/16 where λm is the wavelength under the microstrip line. Moreover, the end of the line 2 terminates in a via forming a short-circuit.

In a known manner, the perimeter of the slot 1 is chosen such that P=kλs where λs is the wavelength guided in the slot and k a positive integer. In the case of a structure of this type, the antenna resonates not only in its fundamental mode but also in all the higher modes, as shown in the curve of FIG. 2 which represents the matching S11 as a function of frequency. This curve is the result of a simulation carried out on an annular slot antenna exhibiting the following characteristics: $R_{moy}$=15 mm, $W_s$=0.4 mm, $W_m$=0.47 mm (width of the feed line), $L_m$=8.5 mm (length of the feed line), $L_m'$=2 mm (distance between the transition and the via). The substrate used to make the antenna of the annular slot type is Rogers 4003 exhibiting a relative permittivity $\epsilon_r$=3.38, a loss tangent tanδ=0.0022 and a thickness h=0.81 mm.

In this case, operation at a frequency $f_0$=2.8 GHz, $f_1$=5.2 GHz $2f_0$ and f2=7.4 GHz≠$3f_0$ is obtained.

Figure 3:
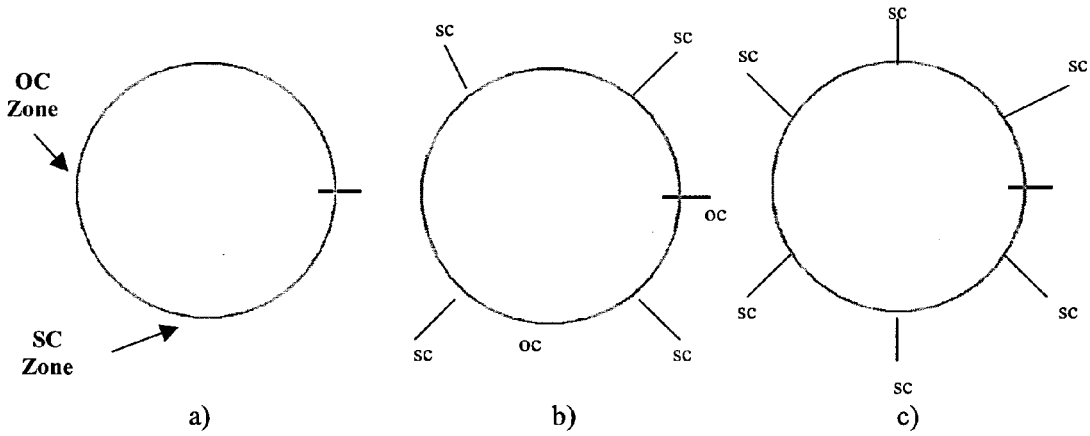
FIG. 3 is a diagrammatic view representing the distribution of the fields in the antenna of FIG. 1 for the fundamental mode, the first higher mode and the second higher mode.

Represented in FIG. 3 are the distributions of fields in the slot of FIG. 1 for the frequencies f0 (fundamental mode), $f_1$ (first higher mode) and $f_2$ (second higher mode).

When FIGS. 3*a*, 3*b* and 3*c*, are examined, it is appreciated that for the fundamental mode, two short-circuit zones and two open-circuit zones are observed. For the first higher mode, four short-circuit zones and four open-circuit zones are observed and for the second higher mode, six short-circuit zones and respectively six open-circuit zones are observed.

The present invention therefore consists in modifying the resonant frequency of each of the modes, independently of the others, by adding projections into short-circuit zones of the annular slot corresponding to the mode chosen. In this way, it is possible to adjust, for each of the modes, the resonant frequency so that it lies substantially at the resonant frequency of the chosen standard with the provision that the various frequency bands lie approximately at multiples of the resonant frequency of the lowest standard The way in which the resonant frequencies for the first three operating modes of an annular slot change when projections are added to the slot will now be described with reference to FIGS. 4 to 9.

Figure 4:
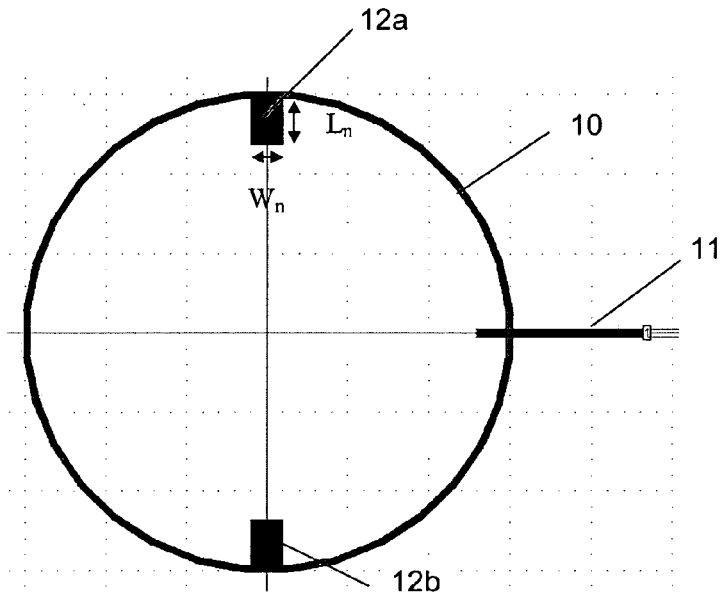
FIG. 4 is a diagrammatic plan view from above of an annular slot with two projections in accordance with the present invention.

Represented in FIG. 4 is an annular slot 10 fed by a feed line 11 in microstrip technology, this annular slot type antenna being of the same type as that of FIG. 1, in particular as regards the feed. In the embodiment of FIG. 4, two projections 12*a*, 12*b* have been positioned in a short-circuit zone for the fundamental mode f0. Each projection is, in the present case, constituted by a rectangle of dimension $W_n$X $L_n$ and exhibits a surface area S0, the projection being made by etching the printed substrate, on the internal profile of the slot.

Figure 5:
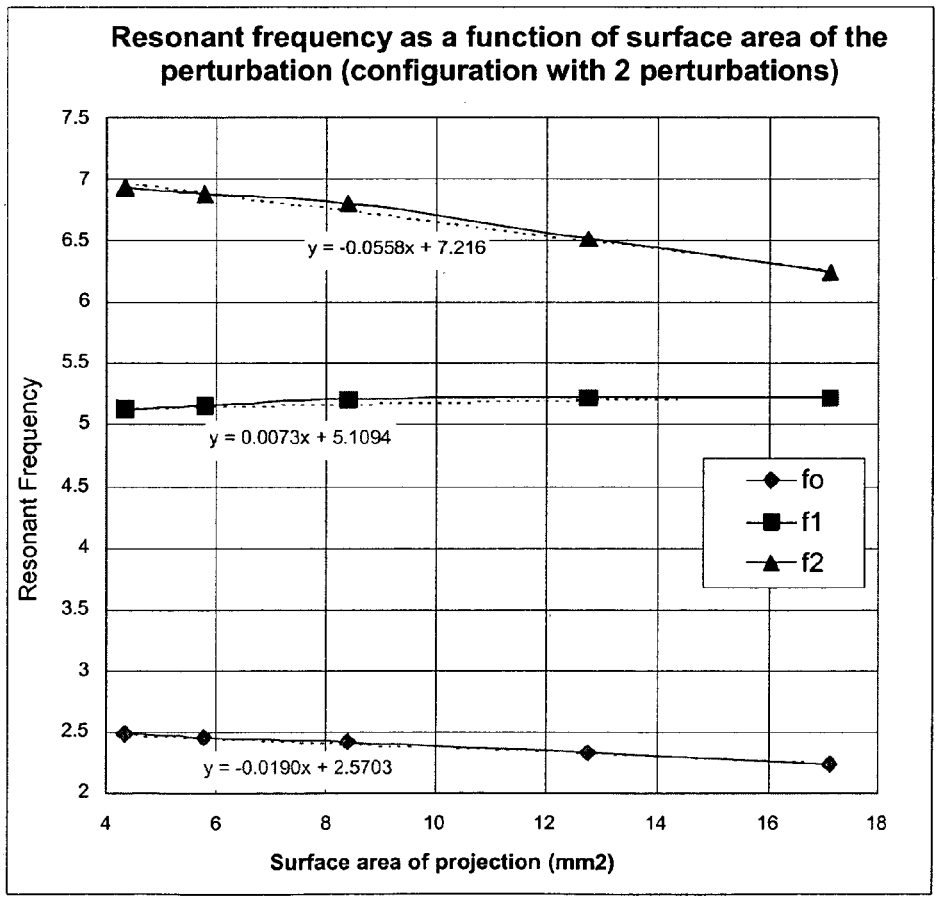
FIG. 5 represents a curve giving the resonant frequency of the fundamental mode as a function of the surface area of the projections in the case of a configuration according to FIG. 4, FIG. 6 diagrammatically represents an annular slot with four projections in accordance with the present invention.

Represented in FIG. 5 is the way in which the resonant frequency of the fundamental mode f0, of the first higher mode f1 and of the second higher mode f2, changes as a function of the variations of the surface area of the projection S0, in the case of the configuration with two projections of FIG. 4. The values have been obtained in the case of an antenna consisting of an annular slot exhibiting a mean radius $R_{moy}$=15 mm, a width $W_s$=0.4 mm, this slot being fed by a feed line 11 having a width $W_m$=0.47 mm, a length $L_m$=8.5 mm and a length $L_m'$=2 mm.

The curves represented in FIG. 5 are of the affine straight line type satisfying the equation $f_i=a_i^k*S^k+b_i^k$ where i ϵ to (0;1;2) and represents the mode, k ϵ to (0;1;2) and represents the projection to which an alteration is made with Sk the surface area of the associated projection and the pair $(a_i^k, b_i^k)$ represent the coefficients of the curve.

Figure 6:
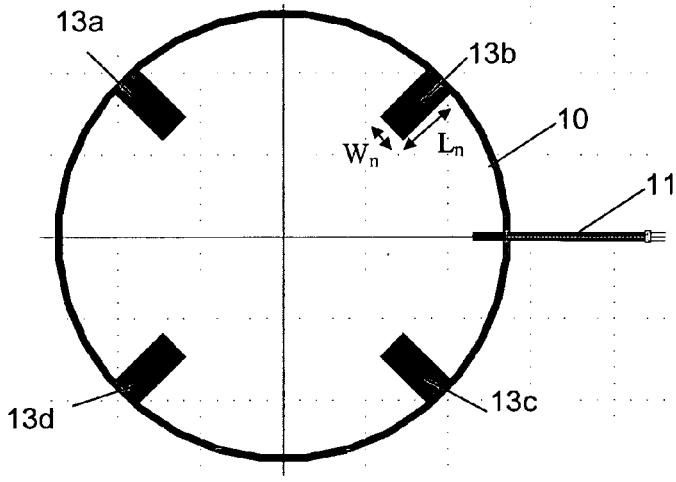
Figure 7:
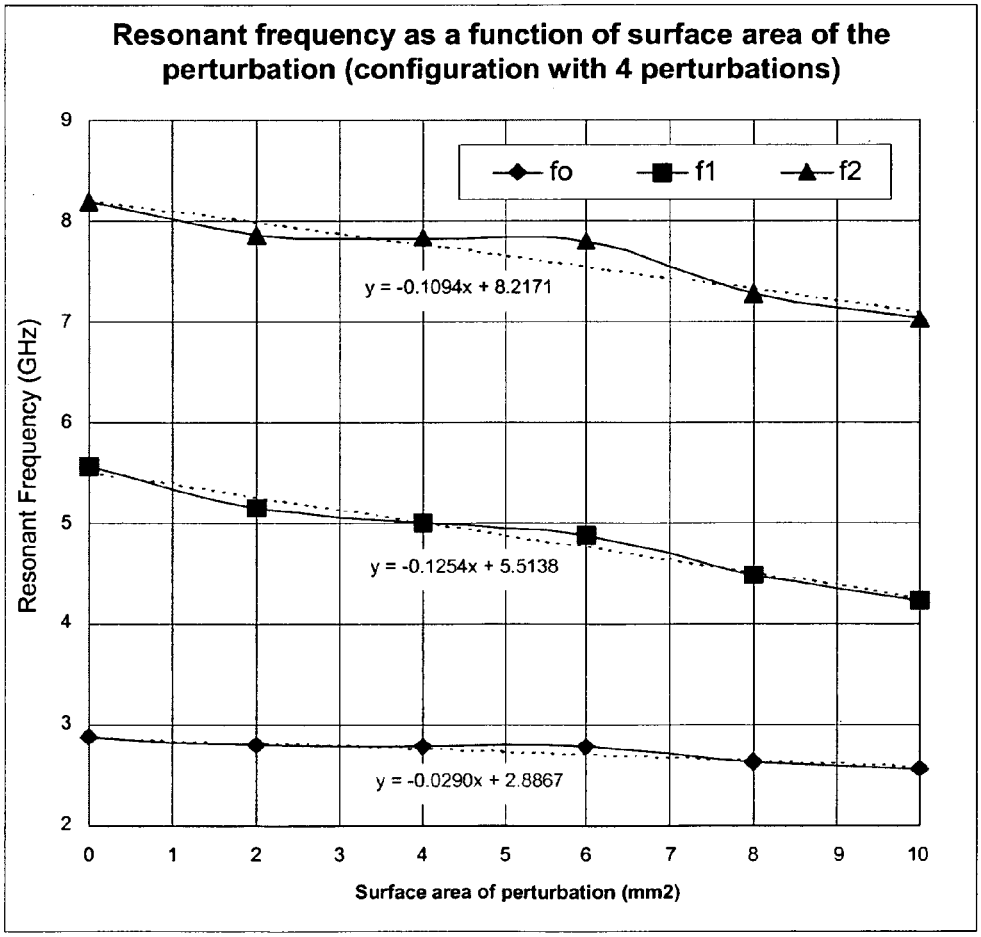
FIG. 7 represents a curve giving the resonant frequency as a function of the surface area of the projections in the case of the configuration according to FIG. 6, FIG. 8 diagrammatically represents an annular slot with six projections in accordance with the present invention.

As represented in FIGS. 6 and 7, the same study has been carried out in the case of an annular slot 10 fed by a microstrip line 11 in an identical manner to what was described in conjunction with FIG. 1, this slot being furnished with four projections. 13*a*, 13*b*, 13*c*, 13*d* made on the internal profile of the slot and positioned in a short-circuit zone for the first higher mode f1, each projection having a surface area S1 . In this case, the resonant frequency of the various fundamental modes, fundamental mode f0, first higher mode f1 and second higher mode f2 as a function of the surface area of the projection S1, is given in FIG. 7.

Figure 8:
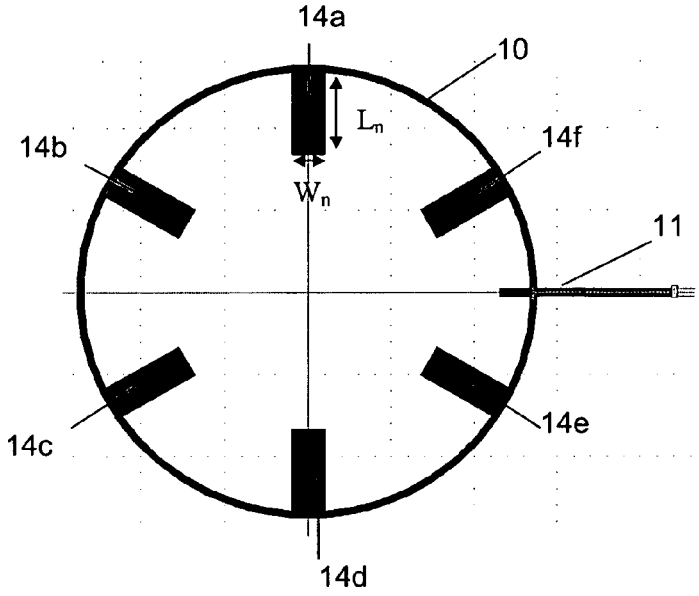
Figure 9:
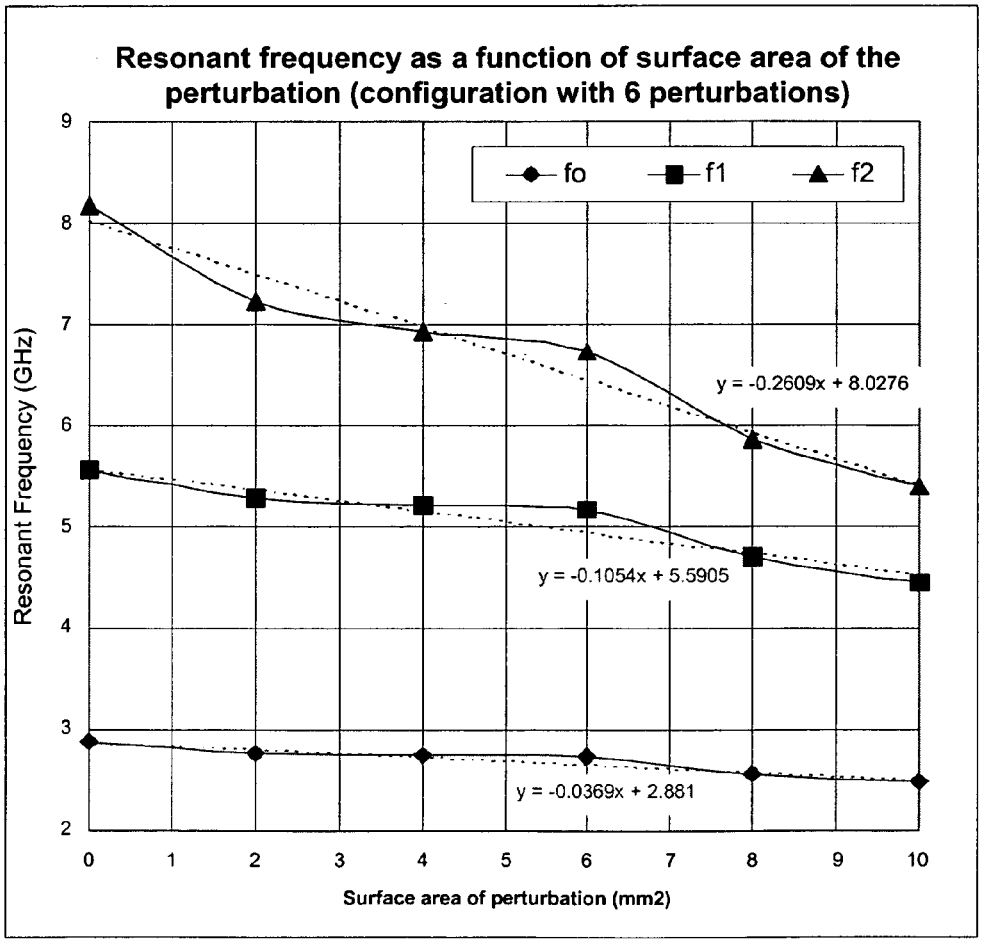
FIG. 9 represents a curve giving the resonant frequency as a function of the surface area of the projections in the case of the configuration according to FIG. 8.

In an identical manner, as represented in FIGS. 8 and 9, a study has been carried out as regards an annular slot 10 fed by a feed line in microstrip technology 11 and furnished in this case with six projections 14*a*, 14*b*, 14*c*, 14*d*, 14*e*, 14*f* made on the internal profile of the slot and positioned in the short-circuit zones corresponding to the second higher mode f2.

In this case, FIG. 9 represents the resonant frequency of the various modes, fundamental mode f0, first higher mode f1 and second higher mode f2, as a function of the surface area of the perturbation S2 corresponding to a configuration with six projections.

The coefficients ($a_i^k$, $b_i^k$) of the curves for each of the modes and for each configuration are given in Table 1 below:

TABLE 1

| 2 notches | a | b | 4 notches | a | b | 6 notches | a | b |
|---|---|---|---|---|---|---|---|---|
| f0 | −0.0190 | 2.5703 | f0 | −0.0290 | 2.8867 | f0 | −0.0369 | 2.8810 |
| f1 | 0.0073 | 5.1094 | f1 | −0.1254 | 5.5138 | f1 | −0.1054 | 5.5905 |
| f2 | −0.0558 | 7.2160 | f2 | −0.1094 | 8.2171 | f2 | −0.2609 | 8.0276 |

Based on the above elements, if the operating frequencies are assumed to be known in the three modes, for example, f0=2.4 GHz, f1=5.25 GHz and f2=5.8 GHz for operation in the bands IEEE 802.11b at 2.4 GHz and IEEE 802.11a in the 5-6 GHz band, it is possible to group all the above coefficients together to obtain a linear system of three equations in three unknowns, in which the unknowns are the projections $S^0$, $S^1$ et $S^2$.

Firstly, the following equality may be written for each mode (i=0, 1 and 2):

$$f_i=a_i^0*S^0+b_i^0=a_i^1*S^1+b_i^1=a_i^2*S^2+b_i^2$$

By adding the same expression 3 times, the following expression is obtained for each mode (i=0, 1 and 2)

$$3*f_i-(b_i^0+b_i^1+b_i^2)=a_i^0*S^0+a_i^1*S^1+a_i^2*S^2$$

which can be easily manipulated into the matrix form:

$$F = A^*S \quad \text{with}$$

$$F = \begin{pmatrix} 3*f_0-(b_0^0+b_0^1+b_0^2) \\ 3*f_1-(b_1^0+b_1^1+b_1^2) \\ 3*f_2-(b_2^0+b_2^1+b_2^2) \end{pmatrix}, \quad A = \begin{pmatrix} a_0^0 & a_0^1 & a_0^2 \\ a_1^0 & a_1^1 & a_1^2 \\ a_2^0 & a_2^1 & a_2^2 \end{pmatrix} \text{ and } S = \begin{pmatrix} S^0 \\ S^1 \\ S^2 \end{pmatrix}$$

The theory of algebra shows that this type of system has a unique solution if and only if the number of equations is equal to the number of unknowns (this being the case: there are three equations in three unknowns) and if and only if the determinant of the matrix A is non zero, this likewise being the case with the values presented in Table 1.

As explained hereinabove, it is therefore possible to adjust the resonant frequencies by combining the various configurations of FIGS. 4, 6 and 8 to obtain the desired resonant frequencies.

A particular embodiment of an antenna of the annular slot type in accordance with the present invention, allowing effective operation for the IEEE802.11a and IEEE802.11b standards, will now be described with reference to FIGS. 10, 11, 12 and 13.

Figure 10:
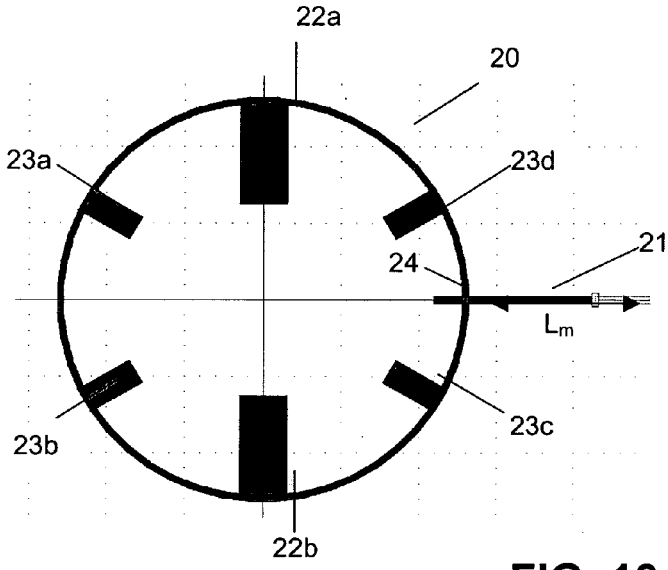
FIG. 10 represents a diagrammatic plan view from above of an annular slot with projections in accordance with the present invention allowing operation in three frequency bands.

FIG. 10 therefore represents an annular slot 20 fed by a feed line 21 of similar structure to that represented in FIG. 1. This annular slot has been obtained by etching a Rogers 4003 substrate of relative permittivity $\epsilon r$=3.38, of loss tangent tanδ=0.0022, of thickness h=0.81 mm. The etched slot 20 exhibits a mean radius $R_{moy}$=13 mm and a width $W_s$=0.4 mm. On the substrate surface opposite the surface receiving the slot is made a feed line 21 in microstrip technology exhibiting a width $W_m$=0.47 mm and dimensions $L_m$=8.5 mm and Lm' between the line/slot transition and the via 24=$\lambda_m$/16=2 mm.

As represented in FIG. 10, the slot 20 is furnished on its internal profile with two projections 22*a*, 22*b* in the short-circuit zones of the fundamental mode f0, these projections 22*a* and 22*b* being of rectangular shape and exhibiting a length $L_n0$=6.5 mm and a width $W_n0$=3 mm. Moreover, four projections are made in short-circuit zones for the second higher mode F2. These projections 23*a*, 23*b*, 23*c* and 23*d* are of rectangular shape and exhibit a length $L_n2$=3.4 mm and a width $W_n2$=1.6 mm.

This annular slot type antenna has been simulated using the IE3D simulation software from Zeland. The simulations gave as matching curve S11 in dB as a function of frequency, that represented in FIG. 11. This matching curve shows the existence of three matching peaks at the frequencies 2.4 GHz, 5.2 GHz and 5.8 GHz which are very close to the resonant frequencies of the relevant standards.

Figure 11:
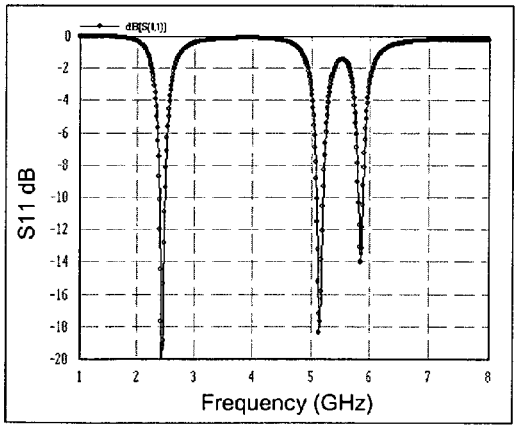
FIG. 11 is a curve keeping the matching, namely the coefficient S11 as a function of the frequency for the structure represented in FIG. 10.
Figure 12:
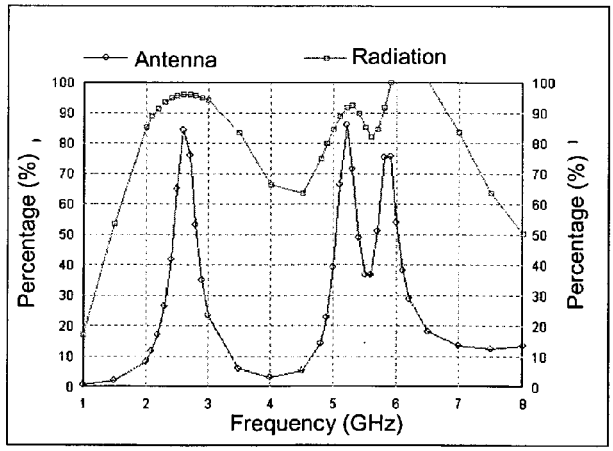
FIG. 12 represents curves giving a percentage of effectiveness as a function of frequency for the antenna represented in FIG. 10.
Figure 13:
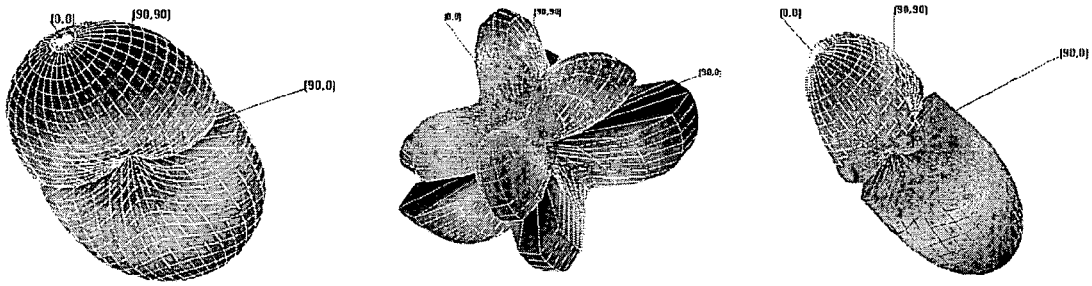
FIG. 13 represents the radiation patterns of the antenna according to FIG. 10, respectively at 2.6 GHz, 5.2 GHz and 5.9 GHz, FIGS. 14*a*, 14*b* and 14*c* diagrammatically represent various shapes for the projections.

The matching curve represented in FIG. 11 is corroborated by the curve of effectiveness of the structure represented in FIG. 12.

FIG. 12 gives two curves of effectiveness, namely the effectiveness of the antenna and the effectiveness of the radiation, these two curves exhibiting three peaks at the frequencies of the three matching peaks.

Moreover, in FIGS. 13*a*, 13*b* and 13*c*, are represented the various radiation patterns of the structure of FIG. 10 at 2.6 GHz for FIG. 13*a*, 5.2 GHz for FIG. 13*b* and 5.9 GHz for FIG. 13*c*. The difference in the shape of the patterns stems from the difference of the excited modes, namely the fundamental mode, the first higher mode and the second higher mode. However, the shape of the radiation remains quasi-omnidirectional.

Figure 14:
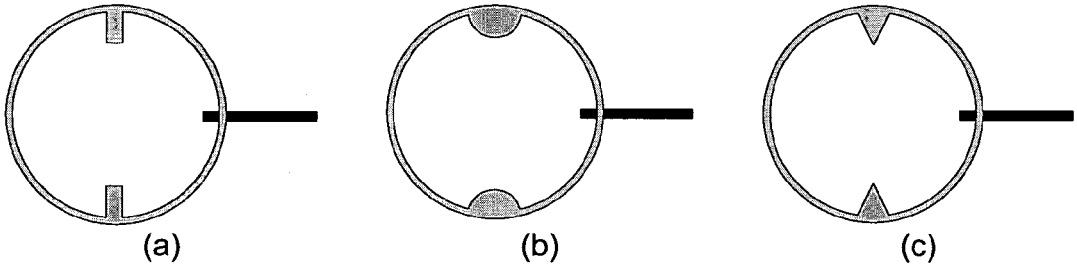

Represented in FIGS. 14*a*, 14*b* and 14*c*, are various shapes for the projections. FIGS. 14*a*, 14*b* and 14*c* correspond to the cases of two projections which are rectangular for FIG. 14*a*, semi-cylindrical for FIG. 14*b* and triangular for FIG. 14*c*. In the case of the present invention, the surface area of the projection rather than its shape has importance for the adjustment of the frequency.

Figure 15:
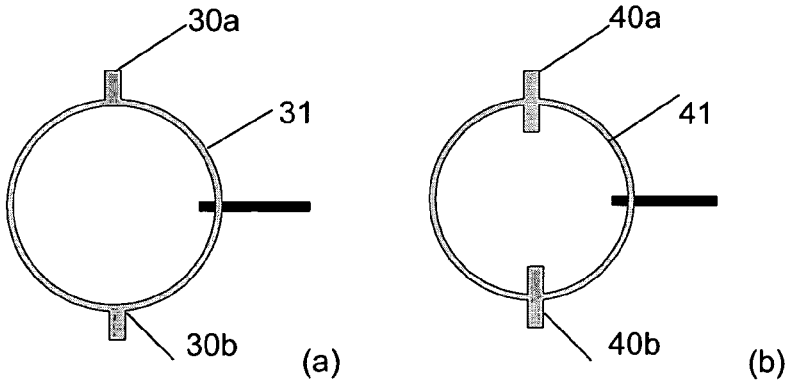
FIGS. 15*a*, 15*b* represent various positions for the projections, in accordance with the present invention.

Represented in FIGS. 15*a* and 15*b*, are various possibilities for the positioning of the projections with respect to the profile of the annular slot. FIG. 15*a* represents two projections 30*a*, 30*b* placed on the outer profile of an annular slot 31 while FIG. 15*b* represents two projections 40*a*, 40*b* of rectangular shape but positioned on both sides of the annular slot 41.

Figure 16:
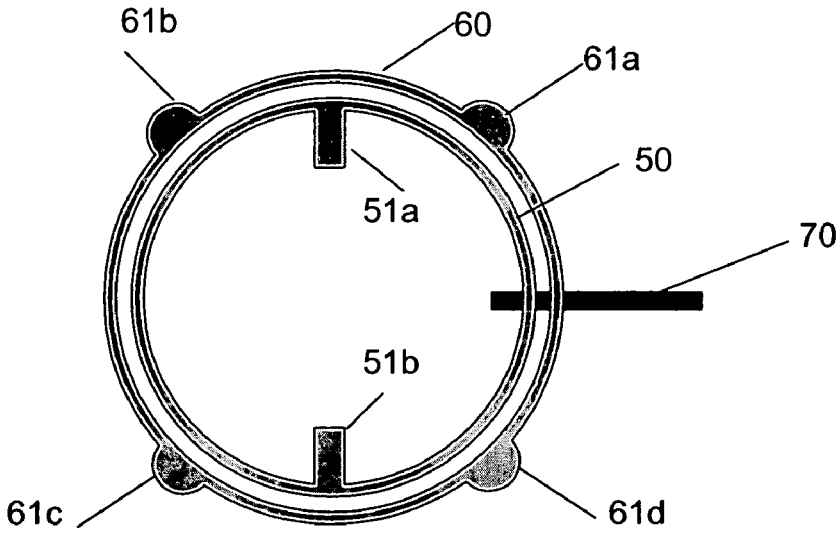
FIG. 16 is a diagrammatic plan view from above of another embodiment of the present invention.

Represented in FIG. 16 is another embodiment of an antenna in accordance with the present invention. In this case, the antenna comprises a first annular slot 50 furnished with two projections 51*a*, 51*b* on the inner profile of the annular slot in the short-circuit zones corresponding to its fundamental mode. Moreover, a second annular slot 60 concentric with the first annular slot 50 is furnished with four projections 61*a*, 61*b*, 61*c*, 61*d* provided on the external profile of the slot 60 in short-circuit zones corresponding to the second higher mode. In the embodiment of FIG. 16, the projections 61*a*, 61*b*, 61*c*, 61*d* are of semi-circular or semi-cylindrical shape.

As in the other embodiments, the two annular slots 50 and 60 are fed by way of a feed line 70 made in this case by microstrip technology. By making it this way it is possible to widen the operating bands.

Figure 17:
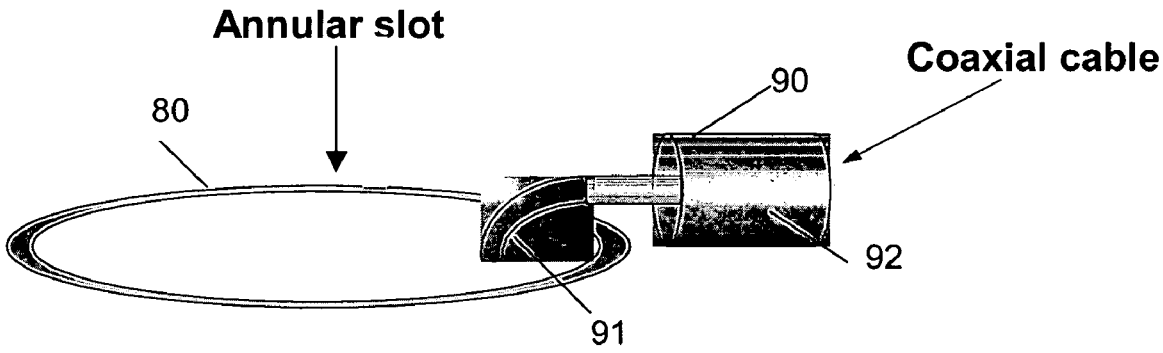
FIG. 17 is a diagrammatic perspective view of another embodiment of the present invention.

Represented in FIG. 17 is yet another embodiment of the present invention. In this schematic perspective representation, the annular slot 80 is fed by a coaxial cable 90 whose internal core 91 is connected to the substrate inside the annular slot while the earth 92 of the coaxial cable is connected to the external metallization of the annular slot 80.

It is obvious to the person skilled in the art that the embodiments described hereinabove are given merely by way of example and that other embodiments could be used within the framework of the present invention. In particular, it is possible to conceive of antenna structures of the annular slot type where any number N of modes would be used as well as structures allowing the coverage of any number M of subbands.

Moreover, within the framework of the present invention, the resonator used could be a resonator of microstrip annulus type instead of an annular slot etched in a metallized substrate.

What is claimed is:

1. A multiband planar antenna consisting of at least one resonator formed of an element having a closed shape made on a substrate and presenting a perimeter $P=k\lambda s$ where $\lambda s$ is the wavelength guided in the slot and k a positive integer, the resonator operating in a fundamental mode at the resonant frequency of the lowest band amongst the multiband, and being fed by a feed line crossing the resonator with resonator/feed line transition positioned to also operate in modes higher than the fundamental mode, the resonator comprising projections positioned in short-circuit zones depending on the various operating modes, said projections having a surface area chosen to modify resonant frequencies of the various operating modes to cover the bands chosen.

2. The antenna according to claim 1, wherein the relation between the resonant frequency of an operating mode and the surface area of the projections is of the type $f_i=a_i^k*S^k+b_i^k$ where i represents the mode, k represents the projection to which the alteration is made, $S^k$ represents the surface area of the associated projection and ($a_i^k$, $b_i^k$) the coefficients of the curve obtained for each mode and for each configuration.

3. The antenna according to claim 1, wherein the projections are of polygonal or cylindrical shape.

4. The antenna according to claim 1, wherein the projections are provided either on the inner profile of the resonator, on the outer profile of the resonator or on both sides.

5. The antenna according to claim 1, wherein the resonator consists of a slot of closed shape etched on a printed substrate, said shape being one of an annular slot or a slot of polygonal shape.

6. The antenna according to claim 1, wherein the resonator consists of a microstrip technology annulus made on a substrate.

7. The antenna according to claim 1, wherein the feed line is made using one of a microstrip technology or coplanar technology, the line terminating in a short-circuit after the feed line/resonator transition.

8. The antenna according to claim 7, wherein the short-circuit is provided at a distance $\lambda m/16$ from the transition with $\lambda m$ the guided wavelength in the feed line.

9. The antenna according to claim 1, wherein the feed line consists of a coaxial cable, with a central core connected to the interior of the resonator and a earth connected to the exterior of the resonator.

* * * * *